United States Patent [19]

Sherwood

[11] 4,199,885

[45] Apr. 29, 1980

[54] ILLUMINATED SIGN AND LAMP BOX ASSEMBLY

[75] Inventor: Edward F. Sherwood, Gettysburg, Pa.

[73] Assignee: Westinghouse Electric Corp., Pittsburgh, Pa.

[21] Appl. No.: 928,638

[22] Filed: Jul. 27, 1978

[51] Int. Cl.[2] ..... G09F 23/00

[52] U.S. Cl. ..... 40/568

[58] Field of Search ..... 40/621, 574, 568, 156, 40/152.1, 564, 152.2

[56] References Cited

U.S. PATENT DOCUMENTS

| | | | |
|---|---|---|---|
| 2,785,490 | 3/1957 | Fabry | 40/621 X |
| 3,418,738 | 12/1968 | Goodman | 40/574 |

FOREIGN PATENT DOCUMENTS

| | | | |
|---|---|---|---|
| 1579382 | 8/1969 | France | 40/574 |

*Primary Examiner*—Louis G. Mancene
*Assistant Examiner*—Wenceslao J. Contreras
*Attorney, Agent, or Firm*—D. R. Lackey

[57] ABSTRACT

An illuminable sign which includes a panel having an opening therein. A lens assembly, which includes at least one magnetic member on its outer periphery, is mountable in the opening from the front side of the panel. The lens assembly is removably secured in the opening via one or more permanent magnets mounted adjacent to the opening on the back side of the panel, which attract the magnetic member, or members.

3 Claims, 3 Drawing Figures

ILLUMINATED SIGN AND LAMP BOX ASSEMBLY

BACKGROUND OF THE INVENTION

1. Field of the Invention

The invention relates in general to displays or signs, and more specifically to displays or signs which include a lens which is illuminated from the back side.

2. Description of the Prior Art

Certain public displays or signs include a lens assembly having a transparent legend or message plate and a transparent lens, which assembly is illuminated from the back by a lamp or other suitable source of light. The lens is normally held in position by a cover plate, which must be removed to gain access to the message plate and/or the lamp, for replacement thereof. This usually involves the removal of a plurality of screws, which is time consuming, and therefore costly. The screws, being viewable by the public, also invite vandalism. The relamping cost is especially high when a relatively large number of such signs are grouped, such as used as tenant signs in an elevator car, as each lamp burn-out necessitates a special service call to simply replace a lamp. If the replacement procedure is time consuming, it adds still further to the cost. The elevator car also presents a fairly severe service burden on a lamp, especially an incandescent lamp, because it is turned on and off in response to car position, and the constant starting and stopping of the car vibrates the lamp filament.

Thus, it would be desirable to simplify the relamping of illuminated displays, as well as the changing of message plates. It would also be desirable to eliminate visible screws or other fastening means which invite vandalism.

SUMMARY OF THE INVENTION

Briefly, the present invention is a new and improved display or sign which includes a lens assembly which is mountable in a panel opening from the front side thereof. The lens assembly includes magnetic material on its periphery. One or more permanent magnets are mounted on the back side of the panel such that they attract and capture the magnetic material and thus the lens assembly, as the lens assembly is inserted into the opening. Thus, no cover plate with its attendant screws is required.

Removal of the lens assembly to replace a lamp mounted on the back side thereof, and/or to change the message plate, merely requires that the attractive force of the magnet, or magnets, be overcome. A suitable suction cup which may be attached to the face of the lens is the only removal tool required.

BRIEF DESCRIPTION OF THE DRAWING

The invention may be better understood, and further advantages and uses thereof more readily apparent, when considered in view of the following detailed description of exemplary embodiments, taken with the accompanying drawings, in which.

DESCRIPTION OF PREFERRED EMBODIMENT

Figure 1:
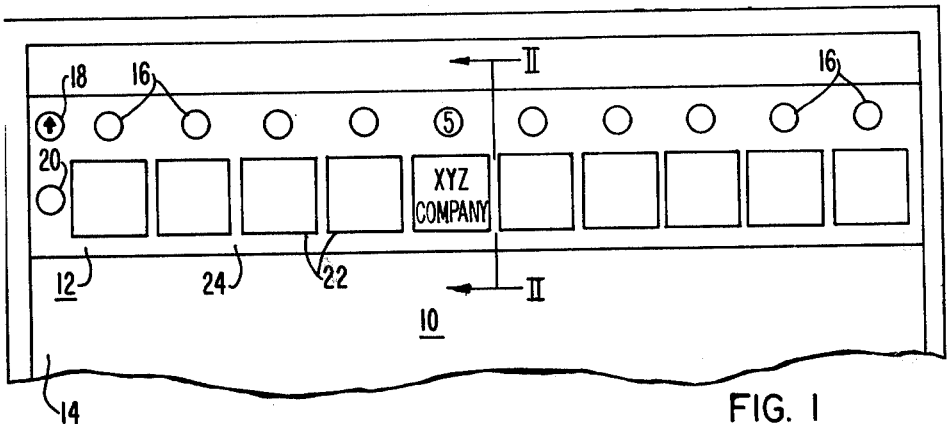
FIG. 1 is an elevational view of a display having a plurality of illuminable signs which are constructed according to the teachings of the invention.

Referring now to the drawing, and to FIG. 1 in particular, there is shown a display 10 constructed according to the teachings of the invention. For purposes of example, the display 10 is illustrated as being a combination of car position indicators and tenant signs mounted inside an elevator car, integral with the cab front, above the door opening. The cab front includes a panel member 12 which forms the transom above door opening 14. The position of the elevator car in the associated building is indicated by a plurality of indicators 16 which illuminate a number on the front of the indicator. Additional indicators 18 and 20 are illuminated to indicate car travel direction.

A plurality of signs are associated with the various floors of the building, and they are selectively illuminated when the associated car position indicator 16 is illuminated, to display a message relative to this floor. For example, the signs may be tenant signs which indicate the occupant, or occupants of the floor, in an office building; or, the signs may indicate the goods or services available at the floor, such as in a department store. As illustrated in FIG. 1, the elevator car is traveling, or set to travel, in the up direction, as shown by indicator 18, and the elevator car is at, or adjacent to, floor No. 5 which houses the XYZ company. In a typical prior art construction, relamping or changing the message plate of sign 22 would require removal of panel 12. The present invention, best illustrated in FIGS. 2 and 3, eliminate the need for a removable panel, enabling relamping and changing the message plates to be accomplished by simply removing the sign 22 from the panel, from the front side of the panel.

Figure 2:
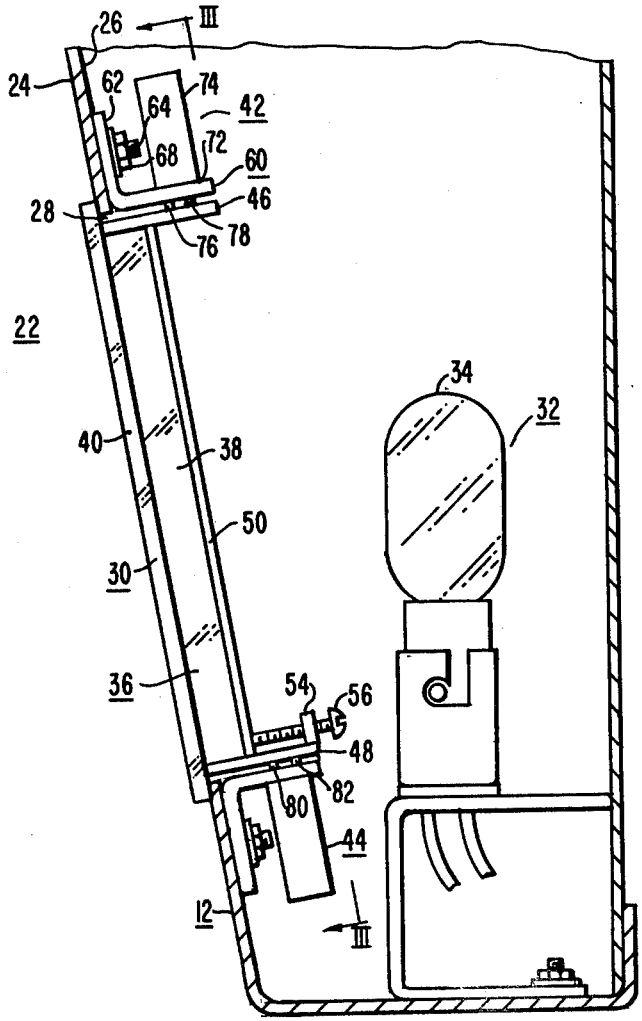
FIG. 2 is a cross-sectional view of a sign shown in FIG. 1, taken between and in the direction of arrows II—II.
Figure 3:
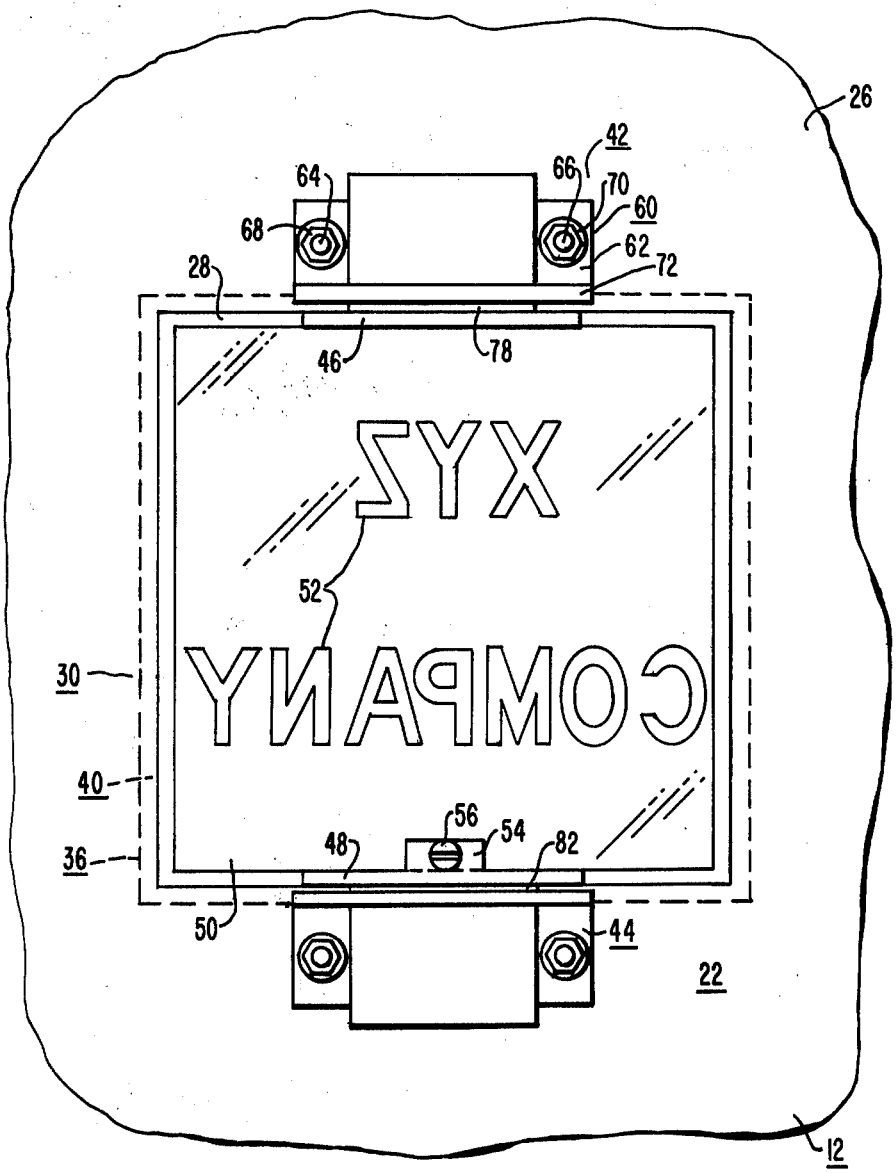
FIG. 3 is a rear view of a lens assembly shown in FIG. 2, taken between and in the direction of arrows III—III.

More specifically, FIG. 2 is a sectional view of the display 10, taken between and in the direction of arrows II—II in FIG. 1, and FIG. 3 is a rear elevational view of sign 22 taken between and in the direction of arrows III—III in FIG. 2. Panel 12 has front and back sides or surfaces 24 and 26, respectively, and openings for each sign 22, such as opening 28.

Sign 22 includes a lens assembly 30, and means 32 for illuminating the back side of the lens assembly, such as the incandescent lamp 34 illustrated, or any other suitable light source.

Lens assembly 30 includes a lens 36 formed of light transmissive material, such as a clear or transparent polycarbonate resin. As illustrated, lens 36 is preferably formed with a first portion 38 which extends to the back surface of the lens, which is sized to enter opening 28, and a second portion 40 which extends to the front surface of the lens 36, which portion is larger than opening 28. Thus, the second portion 40 forms a flange, the underside of which rests against the front surface 24 of panel 12.

The lens assembly 36 is held in assembled position in panel 12 by one or more permanent magnets, and accordingly it includes magnetic material in the form of one or more magnetic members fixed to the periphery of lens portion 38.

For purposes of example, the lens assembly 30 is illustrated as being secured in the panel 12 by first and second permanent magnet assemblies 42 and 44, disposed at opposite sides of opening 28, such as at the top and bottom thereof. Thus, lens assembly 30 includes first and second magnetic members 46 and 48, respectively, such as steel clips, which are fixed to the upper and lower edges of lens portion 38 by a suitable adhesive.

Lens assembly 30 additionally includes a message plate 50 which is disposed against the back side of lens 36. Message plate 50 is formed of a suitable light transmissive material, such as a translucent polycarbonate resin. The legend or art work 52 may be applied directly to message plate 50, it may be engraved with black fill, it may be a silk screened logo and message on overlay film, or the like.

Message plate 50 may be held in the illustrated assembled position in the lens assembly 30 by providing an upstanding tab 54 on steel clip 48 which includes a threaded opening for receiving a screw 56. Screw 56 may be tightened against the message plate 50, to hold the message plate 50 against the back side of the lens 36.

The permanent magnet assemblies 42 and 44 may be of like construction, and thus only assembly 42 will be described in detail. Permanent magnet assembly 42 includes a right angle mounting bracket member 60 having a first leg portion 62 fastened to the back surface 26 of panel 12, immediately above opening 28 such as with studs 64 and 66 and nuts 68 and 70. Right angle bracket member 60 also includes a second leg portion 72 upon which a permanent magnet 74 is mounted. Leg portion 72 includes an opening therein through which pivoted, self-aligning, permanent magnet sections 76 and 78 extend. Bracket member 60 is mounted such that permanent magnet sections 76 will attract and hold the steel clip 46 when the lens assembly 30 is inserted into opening 28. In like manner, permanent magnet sections 80 and 82 of the lower permanent magnet assembly attract and hold steel clip 48, to securely hold lens assembly 30 in the desired position within opening 28.

To replace lamp 34 and/or to change message plate 50, a suction cup may be attached to the front surface of lens 36, and the lens assembly 30 removed by pulling outwardly on the suction cup with a force sufficient to overcome the attractive force between the permanent magnet assemblies 42 and 44 and the clips 46 and 48. It should be noted that no cover plate is used or required. Further, there are no exposed fasteners. The flange 40 of the lens 36 fits snugly against the front surface 24 of panel 12, presenting a neat, finished appearance.

It is to be understood that the number and location of permanent magnet assemblies is not critical to the invention, but have been chosen to illustrate a practical embodiment thereof. An alternate embodiment requiring only one permanent magnet assembly at the top, for example, could be used wherein the bottom of the lens assembly 30 and a bracket disposed at the location of the lower permanent magnet assembly 44 are cooperatively configured to provide a pivotal joint. Upon assembly, the lens assembly 30 would be oriented at a predetermined angle and a lower portion of the lens assembly inserted into the opening such that the lower pivot point is initially made. The lens assembly would then simply be pivoted into the final position where the single permanent magnet assembly 42 would attract and hold the steel clip 46.

I claim as my invention:

1. A sign, comprising:

a panel having front and back sides and an opening therebetween, permanent magnet means mounted adjacent to said opening, on the backside of said panel, and a lens assembly in said opening which includes magnetic material positioned to be attracted to said permanent magnet means by a force which maintains said lens assembly in the opening, said lens assembly being removable from the front side of said panel, by overcoming the attractive force between said permanent magnet means and said magnetic material, said lens assembly including a message plate, and adjustable means for holding said message plate in the lens assembly.

2. A sign comprising:

a panel having front and back sides and an opening therebetween, permanent magnet means mounted adjacent to said opening, on the backside of said panel, and a lens assembly in said opening which includes magnetic material positioned to be attracted to said permanent magnet means by a force which maintains said lens assembly in the opening, said lens assembly being removable from the front side of said panel, by overcoming the attractive force between said permanent magnet means and said magnetic material, said lens assembly including a transparent lens having front and back surfaces on the front and back sides of the panel, respectively, a message plate, adjustable means holding said message plate against the back surface of the lens, and illuminating means disposed on the back side of the panel for illuminating said message plate.

3. The sign of claim 2 wherein the magnetic material of the lens assembly which is attracted to the permanent magnet means includes a metallic right angle member having a first leg portion fastened to the lens, and a second leg portion which includes a threaded opening, and wherein the adjustable means for holding the message plate includes a screw in said threaded opening.

* * * * *